US005495323A

United States Patent [19]

Meetze, Jr.

[11] Patent Number: 5,495,323

[45] Date of Patent: Feb. 27, 1996

[54] CLEAN SPIRAL TONER CARTRIDGE

[75] Inventor: Murray O. Meetze, Jr., Rochester, N.Y.

[73] Assignee: Xerox Corporation, Stamford, Conn.

[21] Appl. No.: 202,616

[22] Filed: Feb. 28, 1994

[51] Int. Cl.[6] ..... G03G 15/06

[52] U.S. Cl. ..... 355/260; 141/256; 222/DIG. 1; 222/83; 222/167; 222/241; 222/252; 222/325

[58] Field of Search ..... 355/260, 245, 355/246; 141/65, 330, 256; 222/DIG. 1, 325, 411, 413, 414, 167, 81, 82, 83, 541, 240, 241, 252, 254

[56] References Cited

U.S. PATENT DOCUMENTS

| | | | |
|---|---|---|---|
| 3,973,699 | 8/1976 | Cook | 222/DIG. 1 X |
| 4,203,533 | 5/1980 | Zeuthen | 222/DIG. 1 X |
| 4,561,567 | 12/1985 | Wittstein et al. | 222/541 X |
| 4,611,730 | 9/1986 | Ikesue et al. | 222/167 |
| 4,641,945 | 2/1987 | Ikesue et al. | 355/245 |
| 4,739,907 | 4/1988 | Gallant | 222/240 |
| 4,744,493 | 5/1988 | Ikesue et al. | 222/167 |
| 4,819,578 | 4/1989 | Koiso et al. | 118/652 |
| 4,878,603 | 11/1989 | Ikesue et al. | 222/167 |
| 4,965,639 | 10/1990 | Manno et al. | 355/260 |
| 4,990,964 | 2/1991 | Kraehn | 355/260 |
| 5,040,024 | 8/1991 | Fukuda et al. | 355/260 |
| 5,057,872 | 10/1991 | Saijo et al. | 355/260 |
| 5,121,168 | 6/1992 | Aoki et al. | 355/298 |

FOREIGN PATENT DOCUMENTS

| | | | |
|---|---|---|---|
| 59-57263 | 4/1984 | Japan | 355/260 |
| 59-67562 | 4/1984 | Japan | 355/260 |
| 60-151669 | 8/1985 | Japan | 355/260 |
| 61-29870 | 2/1986 | Japan . | |
| 62-66285 | 3/1987 | Japan | 355/260 |
| 63-188172 | 8/1988 | Japan | 355/260 |

*Primary Examiner*—Nestor R. Ramirez
*Attorney, Agent, or Firm*—John S. Wagley

[57] ABSTRACT

A device is provided for storing a supply of particles for use in a developer unit of an electrophotographic printing machine. The device comprises an open ended container defining a chamber in communication with the open end thereof. The particles are stored in the chamber of the container. The device further comprises a puncturable seal attached to the open end of the container for sealing the chamber. The container is installable into the developer unit without removal of the seal.

19 Claims, 9 Drawing Sheets

CLEAN SPIRAL TONER CARTRIDGE

The present invention relates to a developer apparatus for electrophotographic printing. More specifically, the invention relates to a cartridge for dispensing toner.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable marking particles typically in the form of a powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll."

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll.

In an electrophotographic printer as the toner within the developer material is transferred to the photoreceptor and eventually to the copy paper, this used toner must be replaced. The electrophotographic printer thus includes a toner container or cartridge from which fresh toner is dispensed into the machine. When using two component developer, a portion of the carrier granules will eventually deteriorate. Additional new carrier granules may be added to the machine to replace the deteriorated granules. The toner container or cartridge may thus alternatively store a mixture including a small quantity of carrier granules in addition to the toner. To provide for a small compact toner cartridge and to provide for a toner cartridge in which the opening to the cartridge may be easily removed, the toner cartridge typically has a compact shape with a small opening from which the toner is dispensed.

Traditionally when all the toner within the container had been consumed, additional toner was supplied to the machine by pouring toner from a separate refilling bottle into the container. This method permitted many toner particles to become airborne during filling and enter the machine. The operator may even miss the opening of the container during filling and spill large quantities of toner inside the machine. Since the toner is inherently very susceptible to electrostatic charges, the toner sticks electrostatically to all the remote recesses of the machine making cleaning of the machine necessary, time consuming, and expensive.

Recently, machines have been supplied with replaceable toner containers or cartridges to avoid some of the problems associated with spilling toner during refilling. While missing the opening of the container during filling and spilling large quantities of toner is alleviated by replaceable toner containers, spillage can occur from the old container during removal and from the new container during installation.

Toner in the toner container or cartridge must be fed therefrom to the latent image to effectuate development. Typically, toner containers are located with their openings in the bottom of the container whereby they may be emptied by gravity. In attempts to make inexpensive and compact electrophotographic printers and to minimize space and related costs, however, the shape of the toner container may not be conducive to a bottom opening or to an unassisted emptying of the container. When the opening is not in the bottom or the geometry of the container does not promote the free flow of all the contents, a mechanism must be provided for removing the toner therefrom. While the demand for toner remains fairly constant, these mechanisms expel large quantities of toner when the container is full and progressively smaller amounts as the container empties.

Cylindrical toner containers are now available with spiral ribs located therein, which when rotated urge the toner to the end thereof. These containers have an opening in the periphery of the container near one end thereof through which toner escapes. A machine interface which must be sealed to the container is used to remove toner from the opening. The risk of dirty surfaces at the opening and the interface and the risk of spilling the toner if the container is tipped during installation remain with these containers.

The following disclosures may be relevant to various aspects of the present invention:

- U.S. Pat. No. 5,121,168 Patentee: Aoki et al. Issue Date: Jun. 9, 1992
- U.S. Pat. No. 5,057,872 Patentee: Saijo et al. Issue Date: Oct. 15, 1991
- U.S. Pat. No. 4,965,639 Patentee: Manno et al. Issue Date: Oct. 23, 1990
- U.S. Pat. No. 4,878,603 Patentee: Ikesue et al. Issue Date: Nov. 7, 1989
- U.S. Pat. No. 4,819,578 Patentee: Koiso et al. Issue Date: Apr. 11, 1989
- U.S. Pat. No. 4,744,493 Patentee: Ikesue et al. Issue Date: May 17, 1988
- U.S. Pat. No. 4,739,907 Patentee: Gallant Issue Date: Apr. 26, 1988
- U.S. Pat. No. 4,641,945 Patentee: Ikesue et al. Issue Date: Feb. 10, 1987

U.S. Pat. No. 4,611,730 Patentee: Ikesue et al. Issue Date: Sep. 16, 1986

The relevant portions of the foregoing disclosures may be briefly summarized as follows:

U.S. Pat. No. 5,121,168 discloses an image forming apparatus for developing a latent image on a photosensitive body. The latent image is developed by a developing device and is transferred onto a sheet of paper and remaining toner on the photosensitive body is removed therefrom by a cleaner. The image forming apparatus has a used toner storing portion for collecting the removed remaining toner thereinto and integral with the developing container.

U.S. Pat. No. 5,057,872 discloses a developer supplying device which includes a substantially cylindrical developer container having on its peripheral surface a spiral groove and being able to rotate to transport a developer therein by the groove. The device includes a supplying element in the form of an opening and a regulating device.

U.S. Pat. No. 4,965,639 discloses a reproduction machine having a rotatable toner supply cartridge which dispenses toner into a developer sump. The cartridge is inclined at an angle with respect to the horizontal axis so as to dispense toner. The dispensing is assisted by gravity in controlled amounts only from the end of the cartridge extending beneath the horizontal.

U.S. Pat. No. 4,878,603 discloses a toner replenishing device for replenishing toner to a toner storage area, from where the toner is supplied to a developing section. The device includes a holder for releasably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position and receiving the first mating member.

U.S. Pat. No. 4,819,578 discloses a toner collecting device for collecting residual toner removed from an image retainer by a cleaning device after a toner image formed on the image retainer has been transferred to a sheet of paper. The toner collecting device has therein a conveyor device for carrying the residual toner. The conveyor device has its leading end portion disposed at a central portion of the toner collecting device. The upper surface of the toner collecting device has functions to guide transfer paper and to support a transfer electrode, and the leading end portion of the conveyor device is provided with a toner distributing diffusion blade member.

U.S. Pat. No. 4,744,493 discloses a toner replenishing device for replenishing toner to a toner storage area, from where the toner is supplied to a developing section. The device includes a holder for releasably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position to the first mating member. Thus, only the cartridge having the first mating member may be properly held by the holder for carrying out a toner replenishing operation.

U.S. Pat. No. 4,739,907 discloses a cylindrical developer storage and dispensing cartridge with a dispensing opening at one end. The cartridge has an integral developer transport mixing and anti-bridging member rotatably supported within the container which has a first coiled spring element having a cross section substantially the same as the cross section of the container and freely rotatable therein. The first element is wound in the direction to transport developer along its length toward the dispensing opening and a second coiled spring element having a cross section substantially smaller than the first spring element, but being substantially concentrically positioned and being attached to the first element but wound in an opposite direction.

U.S. Pat. No. 4,641,945 discloses a toner supply device for supplying a developing unit of an electrophotographic copier with a toner developer which is stored in a cylindrical cartridge. The cartridge is fixed in a horizontal position in the vicinity of the developing unit of the copier while occupying a minimum of space. The toner supply device is desirably applicable to a small-size electrophotographic copier.

U.S. Pat. No. 4,611,730 discloses a toner replenishing device for replenishing toner to a toner storage area, from where the toner is supplied to a developing section. The device includes a holder for releasably holding a cartridge containing therein a quantity of toner. The holder may be located at a cartridge mounting and dismounting position and at a replenishing position. The cartridge is held substantially horizontally and driven to rotate thereby discharging the toner to a toner transporting path leading to the toner storage area. The cartridge is provided with a first mating member and the holder is provided with a second mating member corresponding in position to the first mating member. Thus, only the cartridge having the first mating member may be properly held by the holder for carrying out a toner replenishing operation.

According to the present invention, there is provided a device for storing a supply of particles for use in a developer unit of an electrophotographic printing machine. The device comprises an open ended container defining a chamber in communication with the open end thereof. The particles are stored in the chamber of the container. The device further comprises a puncturable seal attached to the open end of the container for sealing the chamber. The container is installable into the developer unit without removal of the seal.

According to the present invention, there is also provided a device for storing a supply of particles for use in a developer unit of an electrophotographic printing machine. The device comprises an open ended container which defines a chamber in communication with the open end thereof. The particles are stored in the chamber of the container. The device also comprises a feed mechanism which extends through the open end for feeding a controllable amount of particles from the chamber of the container.

According to the present invention, there is also provided a developer unit for developing a latent image recorded on an image receiving member. The unit comprises an open ended container which defines a chamber in communication with the open end thereof. The particles are stored in the chamber of the container. The unit also comprises a feed mechanism extending through the open end for feeding a controllable amount of particles from the chamber of the container.

According to the present invention, there is further provided a method for transporting marking particles from a marking particles storage device defining an aperture on one end thereof, onto an image receiving member for developing a latent image recorded thereon. A conduit extends through the aperture and into a storing chamber. The method comprises the steps of storing the marking particles in the marking particles storage device, urging the marking particles toward the aperture, urging the marking particles through the internal conduit to the chamber for storing the particles, and transporting the particles from the chamber onto the image receiving member.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 2:
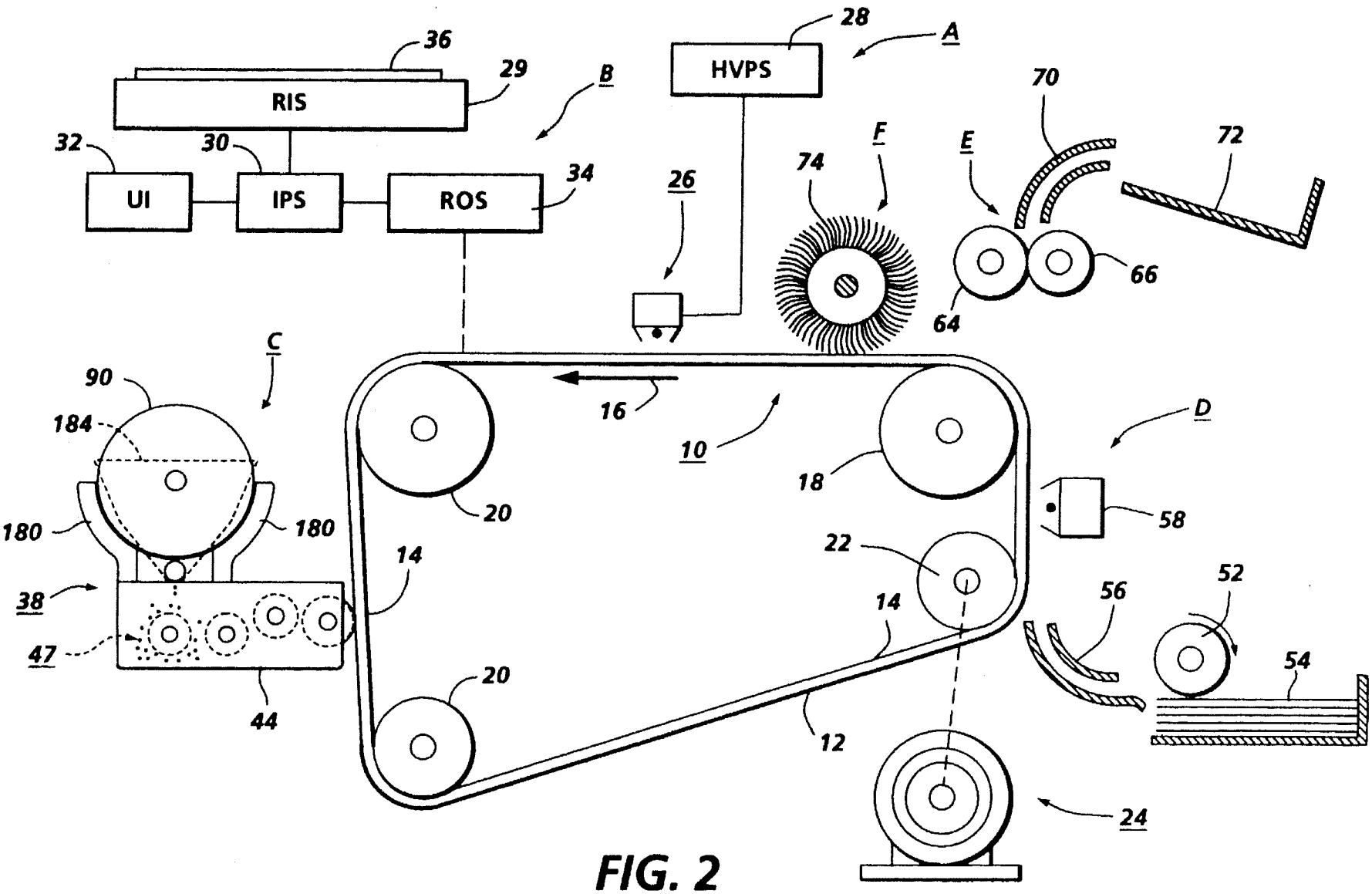
FIG. 2 is a schematic elevational view of an illustrative electrophotographic printing machine incorporating the toner cartridge of the present invention therein.

Referring initially to FIG. 2, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26.

Next, the charged portion of photoconductive surface 12 is advanced through exposure station B. At exposure station B, an original document 36 is positioned on a raster input scanner (RIS), indicated generally by the reference numeral 29. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 30. IPS 30 is the control electronics which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 2. At development station C, a development system 38, develops the latent image recorded on the photoconductive surface. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 2, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions onto the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figures 1, 1A:
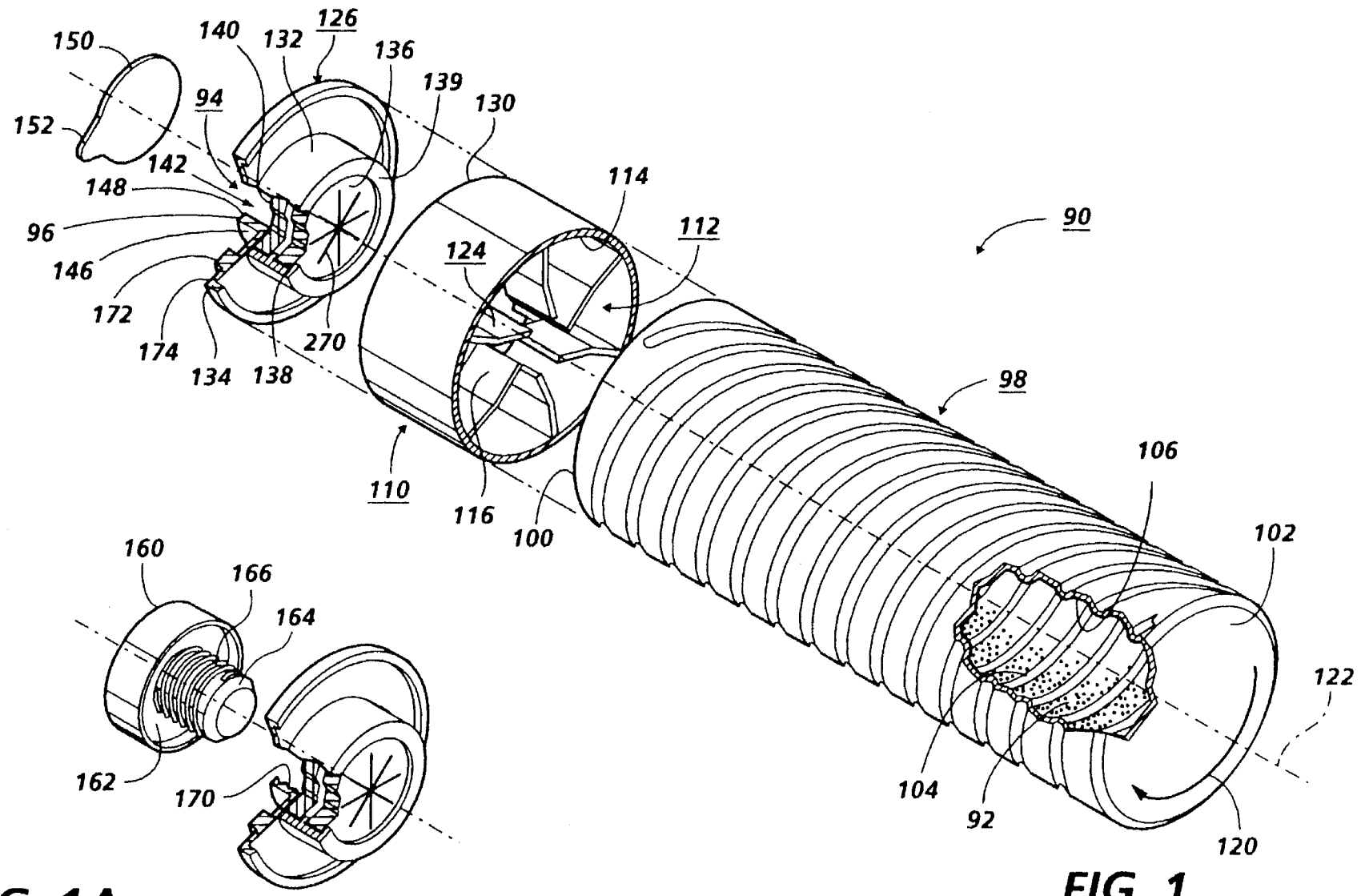
FIG. 1 is an exploded perspective view of a toner cartridge according to the present invention.
FIG. 1A is a partial exploded perspective view of the open end of an alternate embodiment of a toner cartridge according to the present invention.

According to the present invention, and referring to FIG. 1, marking particle container 90, is used to store a supply of marking particles 92. The marking particles are typically in the form of an electrostatically attractable powder known as toner. The container 90 may contain a small quantity of carrier granules (not shown) in addition to the toner particles 92. Marking particle container 90 has a generally cylindrical shape and an opening 94 located on a first end 96 of the marking particle container 90. Preferably, the marking particle container 90 includes a first generally cylindrically shaped portion 98 having an open end 100 proximate the opening 94 and closed end 102 opposite the open end 100. To urge the marking particles 92 from the first generally cylindrical shaped portion 98, the marking particle container 90 preferably includes a spiral rib 104 located on an interior periphery 106 of the cylindrically shaped portion 98. The spiral rib 104 may have either a right hand or a left hand orientation depending on the corresponding rotation of the marking particle container 90.

Marking particle container 90 also includes a ring shaped portion 110 which extends from the open end 100 of the cylindrically shaped portion 98. The ring shaped portion 110 preferably includes radial protrusions 112 which extend inwardly from interior periphery 114 of the ring shaped portion 110.

Preferably, the radial protrusions 112 have a carrying face 116 which curves in the direction of rotation 120 of the container 90 as the radial protrusions 112 extend toward centerline 122 of the container 90. The radial protrusions 112 thereby form pockets 124 along the carrying face 116. These pockets 124 become filled with the marking particles 92 from the open end 100 of the cylindrical shape portion 98 and carry the particles 92 along the inner periphery 114 of the container 90.

The marking particle container 90 further includes a plate shaped end portion 126 which extends from a second face 130 of the ring shaped portion 110. The plate shaped portion 126 includes the first end 96 of the container 90 as well as the opening 94 of the container 90. The plate shaped portion 126 preferably includes an interior hub 132 which extends inwardly from a disc area 134 of the end portion 126. A puncturable seal 136 is preferably located against inside face 138 of lip 139 of the interior hub 132 and is contained within the interior hub 132. The seal 136 serves to contain the marking particles 92 during installation and removal of the marking particle container 90. The puncturable seal 136 will be described in more detail later. To provide sealing in addition to the puncturable seal 136 when the container 90 is installed into the machine, a secondary seal 140 is preferably located in the interior hub 132 spaced outwardly from and parallel to the puncturable seal 136. It should be appreciated that the interior hub 132 may be either a separate component or an integral part of container 90. The secondary seal 140 contains a central opening 142 which slidably fits over auger tube 144 and seals thereto upon installation into the development system 38 (see FIG. 3).

Referring again to FIG. 1, the plate shaped end portion 126 further includes an exterior hub 146 which extends outwardly from the disc area 134. The exterior hub 146 includes an exterior face 148 to which a cover seal 150 is secured during transportation and storage of the marking particle container 90. The cover seal 150 is secured to face 148 by any suitable means such as by gluing. The seal 150 is preferably made from a gas permeable material which will contain the marking particles 92. The seal 150 will permit air pressure to be relieved during high altitude shipping or temperature cycling, thus preventing popping of the seal. Tyvek® material is particularly well suited for this application. The cover seal 150 is used solely during shipment and is removed prior to installation. Preferably, the cover seal 150 includes a tab 152 extending from the seal 150 which may be used in removing the cover seal 150.

Now referring to FIG. 1A, an alternate method of sealing the marking particle container is shown. A cap 160 including a recessed face 162 and a stem 164 extending therefrom is used to replace the cover seal 150 of FIG. 1. The stem 164 includes external threads 166 which mate with internal threads 170 located inside the exterior hub 146 around opening 94. Recessed face 162 seats against exterior face 142 of exterior hub 146 thereby sealing the marking particle container.

Referring again to FIG. 1, the plate shaped end portion 126 further includes pins 172 extending outwardly from outer face 174 of the disc area 134. The pins 172 are used to interconnect with the development system 38 (see FIG. 3).

Figure 3:
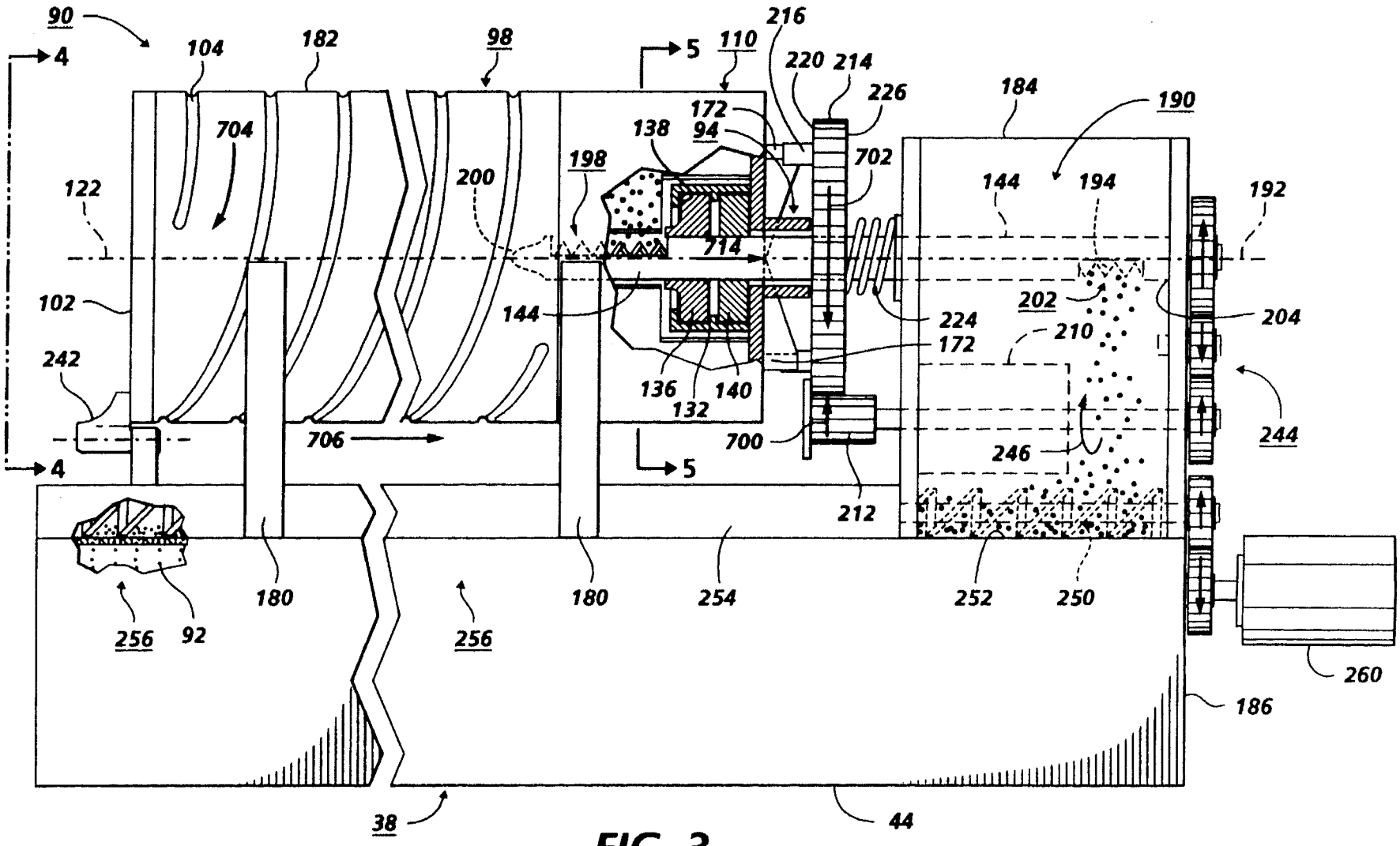
FIG. 3 is a plan view showing the development apparatus used in the FIG. 2 printing machine including the toner cartridge of FIG. 1.

Referring now to FIG. 3, the marking particle container 90 is shown installed in development system 38. Preferably, the marking particle container 90 is installed with centerline 122 of the marking particle container 90 in a horizontal direction. The marking particle container 90 is supported by bottle supports 180. While a plurality of bottle supports 180 is shown in FIG. 3, it can well be appreciated that one wider bottle support may serve equally as well. Exterior surface 182 of the marking particle container 90 contacts the bottle supports 180 and is supported thereby.

The development system 38 includes the developer housing 44 from which the bottle supports 180 extend. A sump housing 184 extends upwardly from one end 186 of the developer housing 44. A feed mechanism 190 extends through the sump housing 184 and outwardly therefrom in the direction of centerline 192. The feed mechanism 190 extends through opening 94 of the marking particle container 90, centerline 192 being co-linear with centerline 122. Preferably, the feed mechanism 190 is in the form of an auger 194 which is located within tube 144. The tube 144 preferably has an inlet opening 198 in the upper portion of the tube 144 near a first end 200 of the tube 144. The tube 144 also has an outlet opening 202 in the bottom portion of the tube 144 near second end 204 of the tube 144. The development system 38 further includes a container drive motor 210 which may be located anywhere within the development system 38, but preferably, is secured to the sump housing 184. The container drive motor 210 serves to rotate the marking particle container 90 as well as auger 194. It should be appreciated, however, that the invention may be practiced with a separate motor for the auger 194 and a separate motor for the marking particle container 90. Any suitable gear train may be used to connect the motor 210 to the auger 194 and to the marking particle container 90. For example, the motor 210 may have a pinion gear 212 extending inwardly therefrom. A sun gear 214 slidably rotates about tube 144 and meshes with pinion gear 212.

To urge the sun gear 214 against the container 90 and assure the mating of the pins 172 with the stops 216, preferably, the development system 38 further includes a spring 224 slidably fitted about tube 144 between the sump housing 184 and second face 226 of the sun gear 214. To interconnect the marking particle container 90 to the feed mechanism 190, stops 216 are located on the a face 220 of the sun gear 214 and are aligned adjacent the pins 172 of the container 90 to cooperate therewith.

Figure 4:
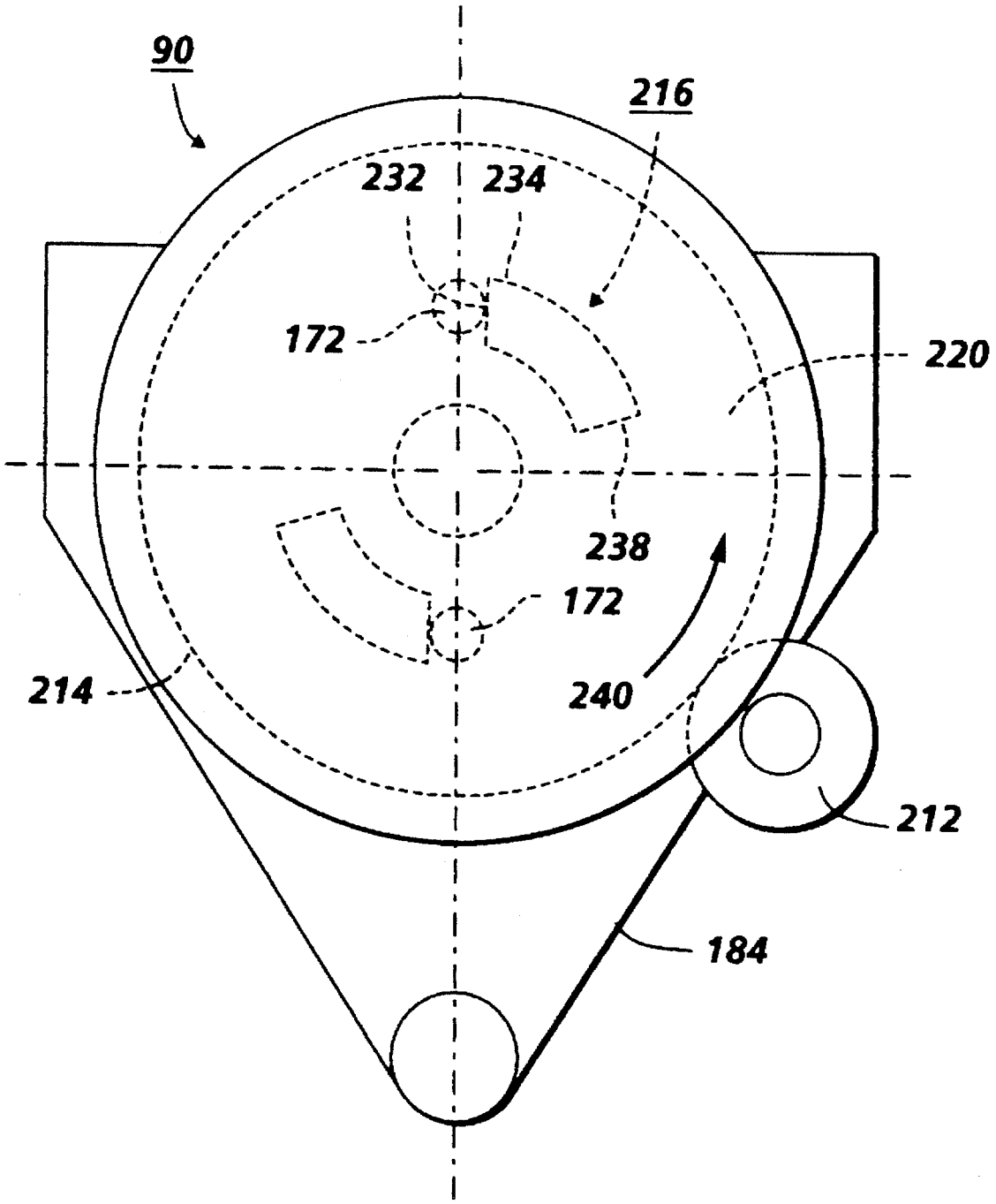
FIG. 4 is a partial plan view along the line 4—4 in the direction of the arrows of the FIG. 3 development apparatus.

Now referring to FIG. 4, the stops 216 are shown in greater detail. While any drive mechanism to interconnect the sun gear 214 to the marking container 90 may be utilized, the configuration shown in FIG. 4 provides for easy installation of the container 90. The stops 216 preferably have an arcuate shape with a face 232 on a first end 234 of the stop. The stops 216 become progressively thinner further from the first end 234 and blend with the first face 220 of gear 214 at a second end 238 of the stop 216. When utilizing the stops 216, the sun gear 214 rotates in a counterclockwise direction 240 until the face 232 of the stops 216 contact pins 172 of the container 90. The container 90 then also rotates in the direction of arrow 240, the container 90 being driven by the sun gear 214 at pins 172.

Referring again to FIG. 3, to assure that the container 90 is adequately axially positioned relative to the feed mechanism 190, a stop 242 located preferably on developer housing 44 secures the marking particle container by restraining closed end 102 of the marking particle container 90. A series of gears 244 preferably interconnect drive motor 210 to the auger 194. The gears 244 are so configured that when motor 210 rotates in the direction of arrow 246, the auger 194 will be rotated in a direction to urge the marking particles 92 from the inlet opening 198 to the outlet opening 202.

The development system 38 further preferably includes a developer auger 250 extending from bottom 252 of the sump housing 184. The auger 250 extends outwardly along the length of developer housing 44. The auger 250 is located within conduit 254. The conduit 254 includes one or more dump holes 256 which permit the marking particles 92 to enter the developer housing 44. While the development auger 250 may be driven by motor 210, preferably, .the auger 250 is driven by a developer auger motor 260 in order to independently control the flow of developer material 92 from the sump housing 184 to the developer housing 44.

Figure 5:
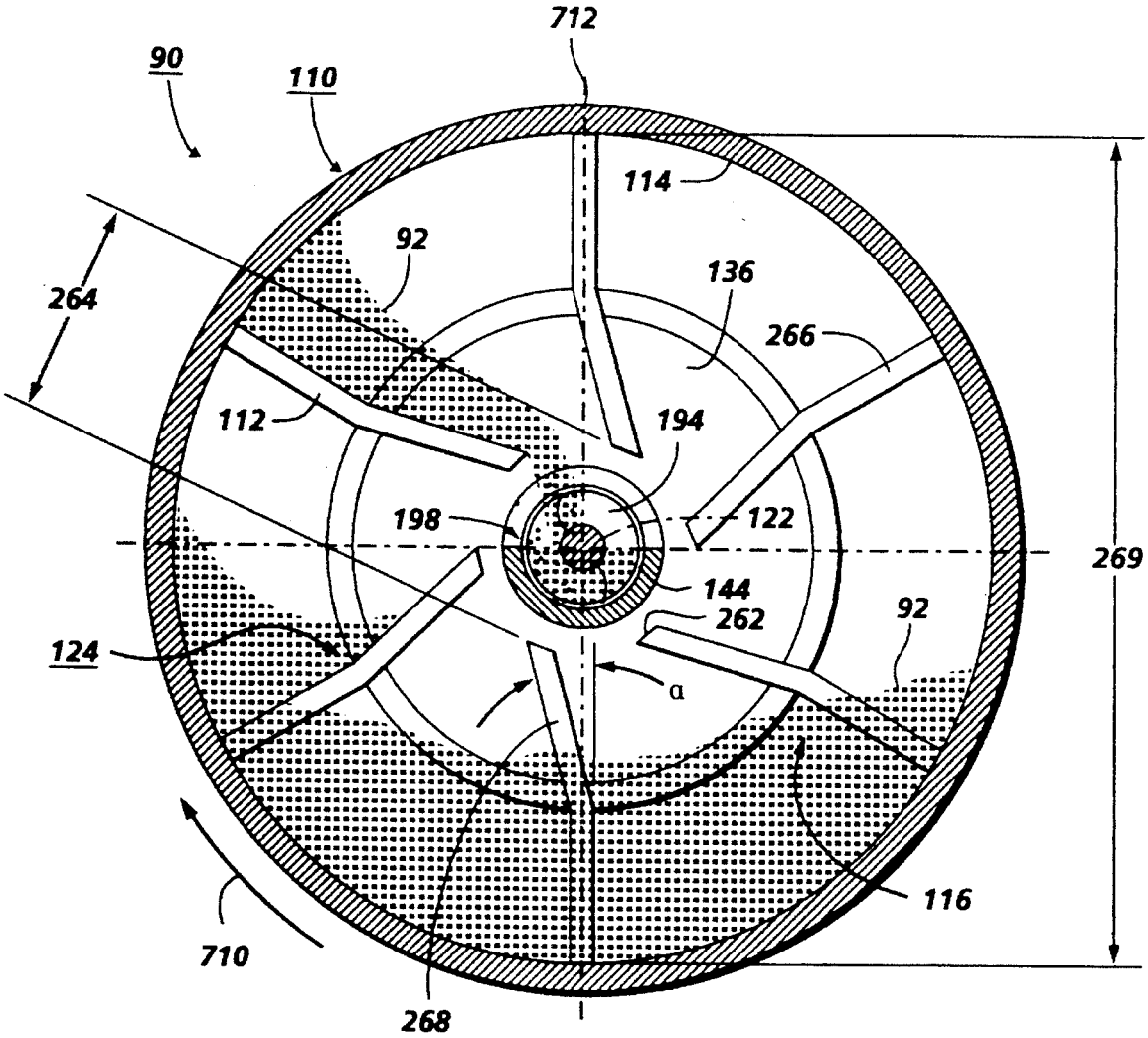
FIG. 5 is a partial sectional view along the line 5—5 in the direction of the arrows of FIG. 3 development apparatus.

Now referring to FIG. 5, the ring shaped portion 110 of the marking particle container 90 is shown in greater detail. The protrusions 112 extend inwardly from inner periphery 114 of the ring shaped portion 110 to an inner face 262 of the protrusions 112 preferably, the position of the inner face 262 is defined by diameter 264 located about centerline 122 of the container 90. Radial angle $\alpha$ of the protrusions 112 defines the angle between first flat portion 266 of the carrying face 116 and second flat portion 268 of the carrying face 116. The amount of marking materials 92 that may be carried by pockets 124 is effected by diameter 269 of the inner periphery 114, by the diameter 264 of the protrusions 112, as well as by radial angle $\alpha$. Radial angle $\alpha$ also effects the position about the container 90 where the toner particles 92 fall. Preferably the radial angle $\alpha$ is an acute angle so that the particles 92 fall into the inlet opening 198. The diameters 264 and 269 and the angle $\alpha$ should thus be selected to provide an adequate amount of marking particles 92 to be carried by the pockets 124.

Again referring to FIG. 3, the puncturable seal 136 and the secondary seal 140 are shown with the container 90 installed into the development system 38. The end 200 of the auger tube 144 first passes through opening 142 of the secondary seal 140. The end 200 of the auger tube 144 then pierces the puncturable seal 136. The puncturable seal 136 remains in a closely conforming position to the auger tube 144 as the tube passes through the seal 136, thereby preventing the spilling of toner particles 92 during installation of the container 90. The excess central portion of the seal 136 is displaced inwardly against the tube 144. The secondary seal 140 provides additional sealing of the container 90 against the tube 144.

Figure 6:
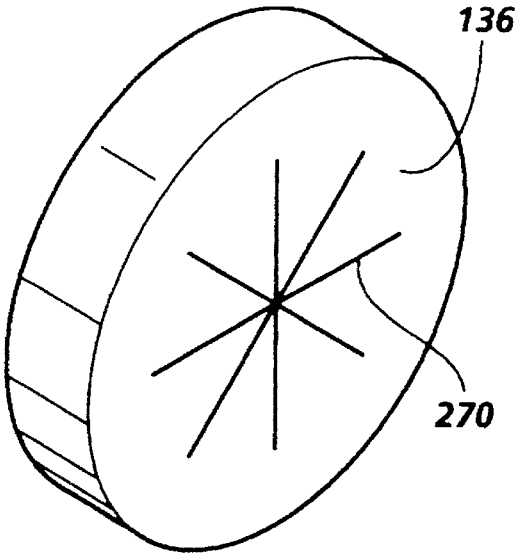
FIG. 6 is a perspective view of a secondary seal for the FIG. 3 development apparatus.

The puncturable seal 136 is shown in more detail in FIG. 6. Prescored marks 270 may be added to the seal 136 to obtain controlled tearing of the seal 136 during puncturing of the seal 136 by the auger tube 144. The seal 136 may be made of any suitable material which is easily pierced and very resilient and preferably is made from a compressible material such as a resilient foam plastic, i.e., polypropylene. The seal 136 and the container 90 may both be made of the same material to assist recycling.

Figure 7:
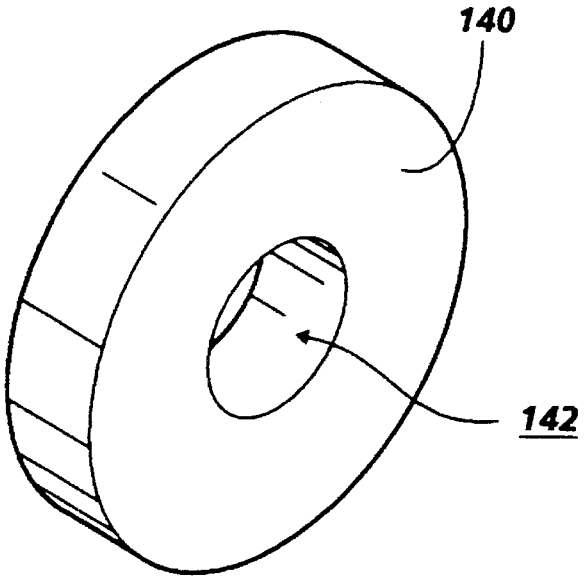
FIG. 7 is a perspective view of a puncturable seal for the FIG. 3 development apparatus.

The secondary seal 136 is shown in more detail in FIG. 7. The opening 142 has a close interference fit with the auger tube 144 to assure proper sealing thereto. The seal 140 may be made of any suitable material that has sufficient density to provide a long life and a sufficiently effective seal. The seal 140 may be made from a compressible material such as a resilient foam plastic, i.e., polypropylene, with a density greater than that of the material used for the puncturable seal 136. As with seal 136, the secondary seal 140 and the container 90 may both be made of the same material to assist recycling.

Figure 8:
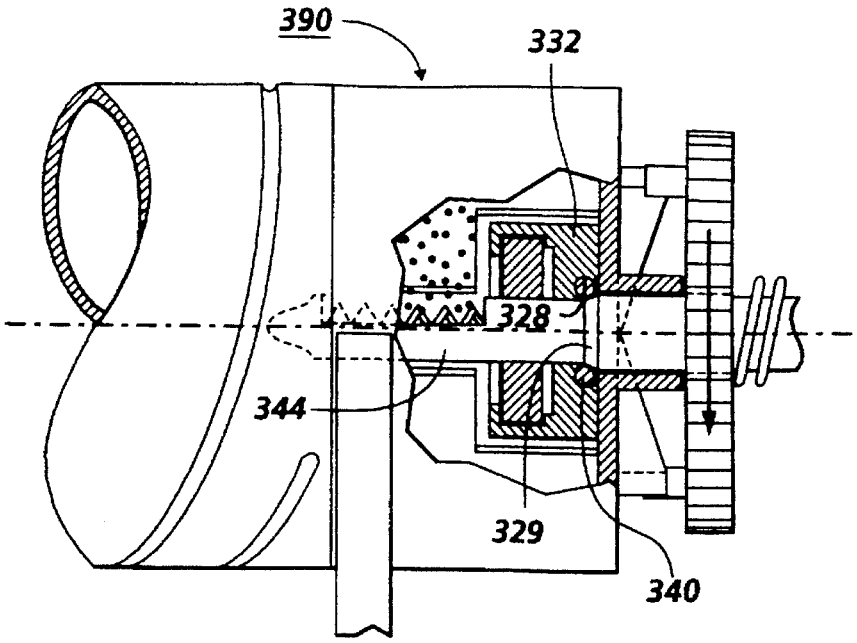
FIG. 8 is a partial plan view of a second embodiment incorporating an O-ring seal of the development apparatus of the present invention.

Now referring to FIG. 8, a second embodiment of the marking particle container of the present invention is shown. The marking particle container 390 is similar to the container 90 of FIG. 3 except that the interior hub 332 of the container 390 includes a pocket 328 into which an O-ring 340 matingly fits. The O-ring 340 serves the function of the secondary seal 140 of FIG. 3. Further, the auger tube 344 is similar to the auger tube 144 of FIG. 3 except that the auger tube 344 further includes shoulder 329 to which O-ring 340 matingly fits to form a secondary seal of the container 390. The O-ring 340 of the container 390 is urged axially against the shoulder 329 of the tube 344 by a spring (not shown).

Figure 9:
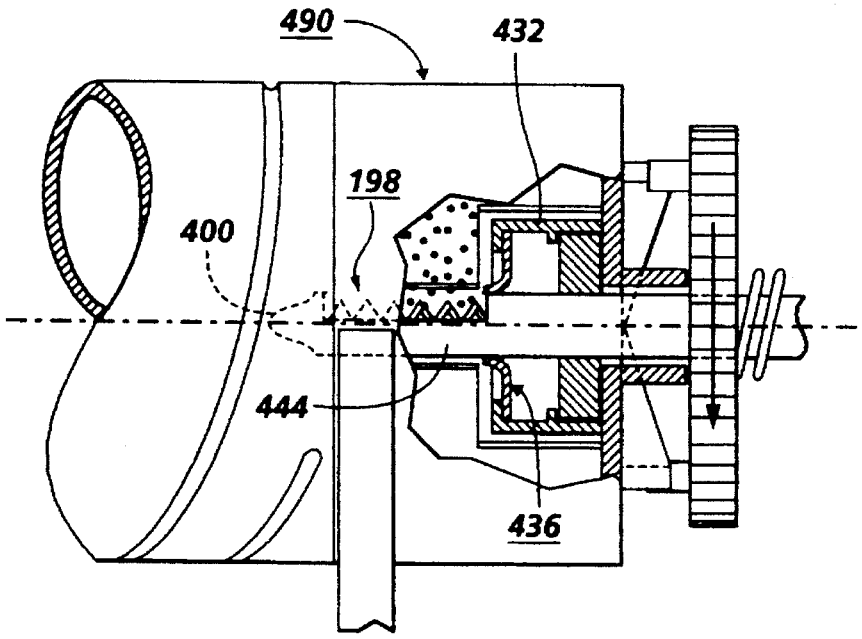
FIG. 9 is a partial plan view of a third embodiment incorporating a membrane seal of the development apparatus of the present invention.

Now referring to FIG. 9, a third embodiment of the marking particle container of the present invention is shown. The marking particle container 490 is similar to the container 90 of FIG. 3 except that the interior hub 432 of the container 490 is modified from the hub 132 of the container 90 of FIG. 3 to contain a puncturable membrane seal 436. The seal 436 serves the function of puncturable seal 136 of FIG. 3.

Figure 10:
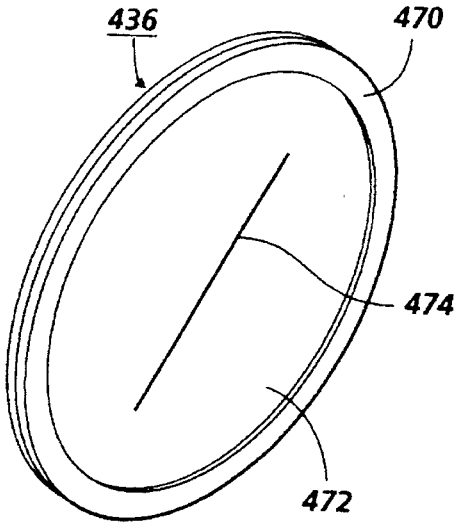
FIG. 10 is a perspective view of an embodiment of a seal for the FIG. 9 development apparatus.

Now referring to FIG. 10, puncturable seal 436 is shown in greater detail. The seal 436 is preferably constructed of two parts: a rigid outer ring 470 and a membrane 472 attached thereto. The membrane 472 may be made of any suitable pliable and conformable material that may be punctured such as a natural or synthetic rubber or a plastic material. During installation the membrane 472 may be punctured by the first end 400 of the tube 444 (see FIG. 9). Again referring to FIG. 10, preferably, however, to avoid having pieces of the membrane 472 become separated from the membrane 472 and thereby contaminate the marking particles, the membrane 472 has a mark 474 prescored into the membrane 472.

Figure 11:
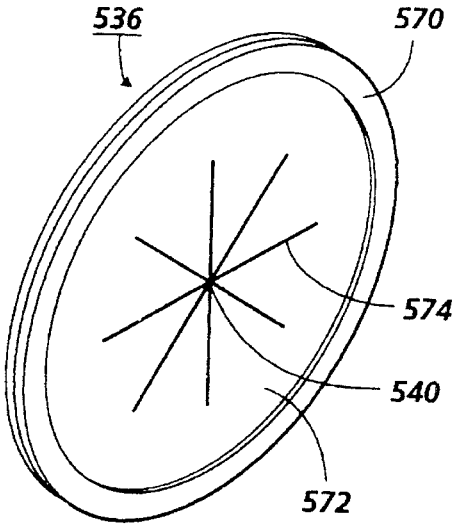
FIG. 11 is a perspective view of a second embodiment of a seal for the FIG. 9 development apparatus.

An alternative seal 536 for the container 490 of FIG. 9 is shown in FIG. 11. The seal 536 like seal 436 of FIG. 10, includes a rigid outer ring 570 and a flexible membrane 572 attached thereto. The membrane includes a central aperture 540 in the membrane 572. A plurality of prescored marks 574 extend outwardly from the central aperture 540. The plurality of prescored marks may provide improved sealing over a single mark when installed in the development system.

Figure 12:
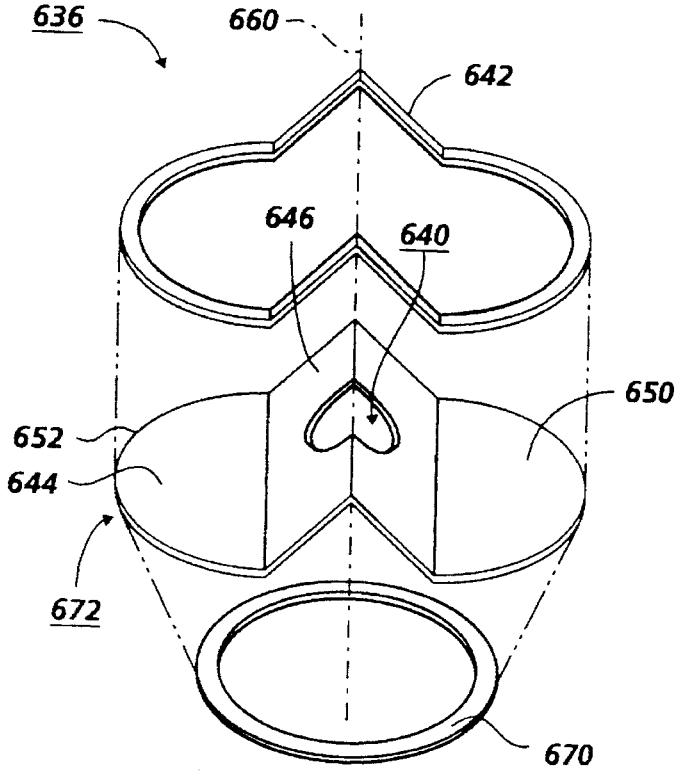
FIG. 12 is a perspective view of a third embodiment of a seal for the FIG. 9 development apparatus.
Figure 13:
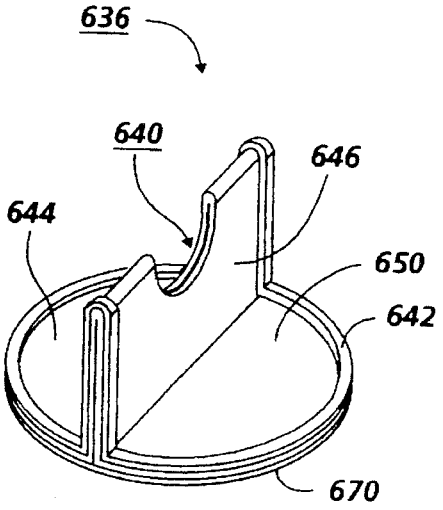
FIG. 13 is a perspective view of the seal of FIG. 8 as assembled for the FIG. 9 development apparatus.

Referring now to FIG. 12, another embodiment of a puncturable seal for use in the container 490 of FIG. 9 is shown in puncturable seal 636. The puncturable seal 636 includes a rigid first outer ring 670, a flexible membrane 672, and a second foldable outer ring 642. The puncturable seal 636 includes a first arcuate portion 644, a collapsible central portion 646, and a second arcuate portion 650. The collapsible central portion 646 includes a centrally located aperture 640. The collapsible central portion 646 is folded about centerline 660 of the aperture 640, folded between the first arcuate portion 644 and the central portion 646, and folded between the collapsible central portion 646 and the second arcuate portion 650. The first arcuate portion 644 and second arcuate portion 650 are secured to the rigid first outer ring 670 and the foldable second outer ring 642 is secured along periphery 652 of the membrane 672. The collapsible central portion 646 is thus folded to close aperture 640. The puncturable seal 636 is shown in assembled condition in FIG. 13. The central portion 646 of seal 636 is installed extending outwardly from the container 90.

Figure 14:
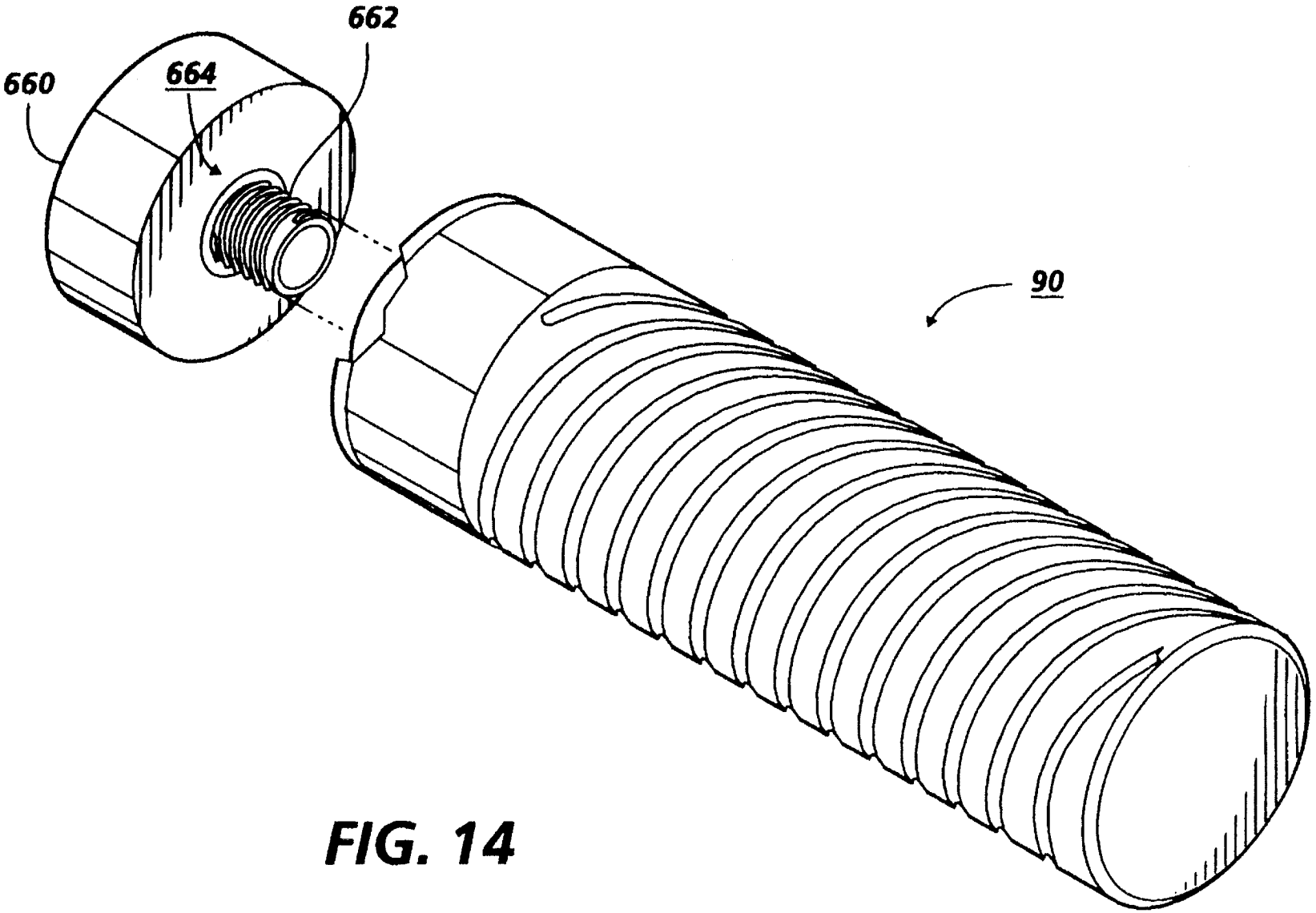
FIG. 14 is an exploded perspective view of the toner cartridge for the FIG. 3 development apparatus shown cooperating with a waste toner cartridge.

Now referring to FIG. 14, the container 90 is shown with a waste container 660 serving a function similar to that of cap 160 of FIG. 1A. Referring again to FIG. 14, the waste container 660 is secured by external threads 662 of a waste container hub 664 to the container 90. After container 90 has been emptied and the waste container 660 has been filled, the containers 660 and 90 may be so threadably connected and returned to the manufacturer for recycling.

Referring again to FIG. 3, the marking particles container 90 is installed by placing the exterior surface 182 of the container 90 against the bottle supports 180 and pushing the container 90 toward sun gear 214 along centerline 122. The tube 144 enters the marking particle container 90 through opening 94, slides through secondary seal 140, and pierces puncturable seal 136. The marking particle container is moved further along centerline 122 until the pins 172 contact the stops 216 of the sun gear 216 and spring 224 begins to compress. Once the spring 224 has been sufficiently compressed, the stop 242 contacts closed end 102 of the container 90 thereby securing the container 90 within the development system 38.

To operate the machine, the drive motor 210 is energized rotating pinion gear 212 in the direction of arrow 700. Sun gear 214 is thereby rotated in the direction of arrow 702. Stop 216 located on sun gear 214 then contacts pins 152 causing the container 90 to rotate in the direction of arrow 704. Ribs 104 in the container 90 urge the marking particles 92 toward opening 94 in direction of arrow 706 from cylindrical portion 98 to ring shaped portion 110.

Now referring again to FIG. 5, the marking particles 92 which have been urged by the ribs 104 into the ring shaped portion 110, are trapped in the pockets 124. The marking particles 92 then are lifted by the protrusions 112 and carried in the direction of rotation 710 in the pockets 124 to the top 712 of the ring shaped portion 110. When the particles are at the top 712, the particles 92 fall into inlet opening 198 of the tube 144 and are thereby carried away by the auger 194.

Again referring to FIG. 3, the marking particles received at inlet opening 198 translate along auger 194 in the direction of arrow 714 toward outlet opening 202. The marking particles exit the tube 144 at outlet opening 202 and fall to the bottom 252 of the sump housing 184. Auger 250 then carries the marking particles along conduit 254 and through dump holes 256 to the developer housing 44 where they are used in the developing process.

The pockets 124 formed by the radial protrusions 114 in the ring shaped portion 110 of the marking particle container 90 serve to provide an ample amount of marking particles 92 to the sump housing 184 and eventually to developer housing 44. The pockets 124 also serve to provide for a thorough and complete emptying of the marking particle container 90, making disposal of the container 90 more environmentally friendly.

The use of puncturable seal 136 provides for a clean and simple installation of the marking particle container 90 into the development system 38 and a simple and clean removal therefrom. The resiliency of the puncturable seal 136 results in maintaining a sealed system at all times, even if the container is removed prior to emptying, is handled and moved around and is later reinstalled in the machine. The central end location of the opening of the container 90 from which toner is extracted permits simpler and more efficient sealing of the container to the developer unit.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A device for storing a supply of particles for use in a developer unit of an electrophotographic printing machine, comprising:

an open ended container defining a chamber in communication with the open end thereof with the particles being stored in the chamber of said container;

a puncturable seal attached to the open end of said container for sealing the chamber, said container being installable into the developer unit without removal of said seal; and a spiral member, a portion thereof located in said container, for urging the particles in the chamber toward the open end of said chamber.

2. A device for storing a supply of particles for use in a developer unit of an electrophotographic printing machine, comprising:

an open ended container defining a chamber in communication with the open end thereof with the particles being stored in the chamber of said container; and a puncturable seal attached to the open end of said container for sealing the chamber, said container being installable into the developer unit without removal of said seal; and a spiral rib formed on an internal periphery of said container, for urging the particles in the chamber toward the open end of said chamber.

3. A device according to claim 2, wherein said container comprises a first generally ring shaped portion located adjacent the open end of said container, said ring shaped portion including an inwardly extending radial protrusion and a second generally cylindrically shaped portion extending from said ring shaped portion in a direction opposite the open end with said spiral rib being disposed in said cylindrical portion.

4. A device for storing a supply of particles for use in a developer unit of an electrophotographic printing machine, comprising:

an open ended container defining a chamber in communication with the open end thereof with the particles being stored in the chamber of said container; and a puncturable seal attached to the open end of said container for sealing the chamber, said container being installable into the developer unit without removal of said seal, said puncturable seal includes a compressible foam material, said seal including a resilient material so that the seal effectively contains the particles upon a puncture of said seal.

5. A device for storing a supply of particles for use in a developer unit of an electrophotographic printing machine, comprising:

an open ended container defining a chamber in communication with the open end thereof with the particles being stored in the chamber of said container;

a puncturable seal attached to the open end of said container for sealing the chamber, said container being installable into the developer unit without removal of said seal, said puncturable seal including a puncturable material; and a secondary seal spaced from and generally parallel to said puncturable seal, said secondary seal including a compressible material, said puncturable seal and said secondary seal including different materials.

6. A device according to claim 5, wherein said puncturable seal comprises a membrane.

7. A device for storing a supply of particles for use in a developer unit of an electrophotographic printing machine, comprising:

an open ended container defining a chamber in communication with the open end thereof with the particles being stored in the chamber of said container;

a puncturable seal attached to the open end of said container for sealing the chamber, said container being installable into the developer unit without removal of said seal; and a cap for sealing the chamber of said container, said cap being in threaded engagement with said container, said cap includes a waste container for storing waste material.

8. A device for storing a supply of particles for use in a developer unit of an electrophotographic printing machine, comprising:

an open ended container defining a chamber in communication with the open end thereof with the particles being stored in the chamber of said container; and a puncturable seal attached to the open end of said container for sealing the chamber, said container being installable into the developer unit without removal of said seal, said puncturable seal includes a first arcuate portion, a second arcuate portion spaced from said first arcuate portion, and a central portion connecting said first portion and said second portion, said central portion defining a central aperture, said central portion being collapsible to close the aperture and being expandable to open the aperture.

9. A device for storing a supply of particles for use in a developer unit of an electrophotographic printing machine, comprising:

an open ended container defining a chamber in communication with the open end thereof with the particles being stored in the chamber of said container;

a feed mechanism extending through the open end for feeding a controllable amount of particles from the chamber of said container; and a spiral member, a portion thereof located in said container, for urging the particles in the chamber toward the open end of said chamber.

10. A device for storing a supply of particles for use in a developer unit of an electrophotographic printing machine, comprising:

an open ended container defining a chamber in communication with the open end thereof with the particles being stored in the chamber of said container;

a feed mechanism extending through the open end for feeding a controllable amount of particles from the chamber of said container; and a spiral rib formed on an internal periphery of said container, for urging the marking particles in the chamber toward the open end of said chamber.

11. A device according to claim 10, wherein said container comprises a first generally ring shaped portion located adjacent the open end of said container, said ring shaped portion including an inwardly extending radial protrusion and a second generally cylindrically shaped portion extending from said ring shaped portion in a direction opposite the open end with said spiral rib being disposed in said cylindrical portion.

12. A device according to claim 11, wherein said radial protrusions transport the particles around the internal periphery of said container.

13. A device for storing a supply of particles for use in a developer unit of an electrophotographic printing machine, comprising:

an open ended container defining a chamber in communication with the open end thereof with the particles being stored in the chamber of said container;

a feed mechanism extending through the open end for feeding a controllable amount of particles from the chamber of said container; and driving means located on the open end of said container for transmitting torque from the development unit to said container.

14. A developer unit for developing with particles a latent image recorded on an image receiving member, comprising:

an open ended container defining a chamber in communication with the open end thereof with the particles being stored in the chamber of said container;

a feed mechanism extending through the open end for feeding a controllable amount of particles from the chamber of said container; and a spiral member, a portion thereof located in said container, for urging the particles in the chamber toward the open end of said chamber.

15. A developer unit for developing with particles a latent image recorded on an image receiving member, comprising:

an open ended container defining a chamber in communication with the open end thereof with the particles being stored in the chamber of said container;

a feed mechanism extending through the open end for feeding a controllable amount of the particles from the chamber of said container; and a spiral rib formed on an internal periphery of said container, for urging the particles in the chamber toward the open end of said chamber.

16. A developer unit according to claim 15, wherein said container comprises:

a first generally ring shaped portion located adjacent the open end of said container, said ring shaped portion including an inwardly extending radial protrusion; and a second generally cylindrically shaped portion extending from said ring shaped portion in a direction opposite the open end with said spiral rib being disposed in said cylindrical portion.

17. A developer unit according to claim 16, wherein said radial protrusion transports the particles around the internal periphery of said container.

18. A developer unit for developing with particles a latent image recorded on an image receiving member, comprising:

an open ended container defining a chamber in communication with the open end thereof with the particles being stored in the chamber of said container; and a feed mechanism extending through the open end for feeding a controllable amount of particles from the chamber of said container, said feed mechanism includes a conduit extending only partially into the chamber and an auger mounted in said conduit.

19. A method for transporting marking particles from a marking particles storage device, the device defining an aperture on one end thereof, onto an image receiving member for developing a latent image recorded thereon, a conduit extending through the aperture and into a storing chamber, said method comprising the steps of:

storing the marking particles in the marking particles storage device;

urging the marking particles toward the aperture along the periphery of the marking particles storage device;

urging the marking particles along the periphery into the conduit;

urging the marking particles through the conduit to the chamber for storing said particles; and transporting the particles from the chamber onto the image receiving member.

* * * * *